US010697414B2

(12) United States Patent
Mikhaylov et al.

(10) Patent No.: US 10,697,414 B2
(45) Date of Patent: Jun. 30, 2020

(54) HIGH-PRESSURE FUEL PUMP FOR A FUEL INJECTION SYSTEM

(71) Applicant: CPT Group GmbH, Hannover (DE)

(72) Inventors: Yury Mikhaylov, Landshut (DE); Thomas Fuchs, Fladungen (DE)

(73) Assignee: VITESCO TECHNOLOGIES GMBH, Hannover (DE)

( * ) Notice: Subject to any disclaimer, the term of this patent is extended or adjusted under 35 U.S.C. 154(b) by 0 days.

(21) Appl. No.: 16/364,506

(22) Filed: Mar. 26, 2019

(65) Prior Publication Data

US 2019/0293037 A1 Sep. 26, 2019

(30) Foreign Application Priority Data

Mar. 26, 2018 (DE) ..... 10 2018 204 556

(51) Int. Cl.
*F02M 59/44* (2006.01)
*F04B 11/00* (2006.01)
(Continued)

(52) U.S. Cl.
CPC ..... *F02M 59/442* (2013.01); *F02M 55/04* (2013.01); *F02M 57/023* (2013.01);
(Continued)

(58) Field of Classification Search
CPC .. F02M 59/442; F02M 59/102; F02M 59/025; F02M 59/466; F02M 63/024;
(Continued)

(56) References Cited

U.S. PATENT DOCUMENTS 6,062,831 A * 5/2000 Konishi ..... F02M 55/04 417/540
7,604,462 B2 * 10/2009 Inoue ..... F04B 5/00 417/53

(Continued)

FOREIGN PATENT DOCUMENTS

DE 10 2013 212 557 A1 12/2014 ..... F16L 55/04
DE 10 2017 203 762 A1 9/2018 ..... F02M 55/04
WO 2017/050467 A1 3/2017 ..... F02M 55/04

OTHER PUBLICATIONS

German Office Action, Application No. 10 2018 204 556.9, 7 pages, dated Jan. 10, 2019.

*Primary Examiner* — George C Jin
(74) *Attorney, Agent, or Firm* — Slayden Grubert Beard PLLC

(57) ABSTRACT

Various embodiments include a high-pressure fuel pump for a fuel injection system comprising: a housing defining a housing bore with a pressure chamber in a first end region and a leakage chamber in a second end region; a pump piston, during operation of the high-pressure fuel pump moved in translation between the pressure chamber and the leakage chamber along an axis; wherein the leakage chamber includes a leakage collecting region and an equalizing region arranged in circular annular fashion around the pump piston guiding section and extending parallel to the axis from the leakage collecting region toward the pressure chamber; and a low-pressure damper arranged in the equalizing region, the low-pressure damper comprising an annular piston damper and an annular piston guided to move along the axis within an annular bushing.

9 Claims, 4 Drawing Sheets

(51) Int. Cl.

| | |
|---|---|
| ***F02M 55/04*** | (2006.01) |
| ***F02M 57/02*** | (2006.01) |
| ***F02M 59/10*** | (2006.01) |
| ***F02M 63/02*** | (2006.01) |
| *F02M 63/00* | (2006.01) |

(52) U.S. Cl.
CPC ..... *F02M 59/102* (2013.01); *F02M 59/44* (2013.01); *F02M 63/024* (2013.01); *F04B 11/0091* (2013.01); *F02M 63/0003* (2013.01); *F02M 2200/315* (2013.01); *F02M 2200/40* (2013.01)

(58) Field of Classification Search
CPC .. F02M 63/0003; F02M 57/023; F02M 55/04; F02M 37/0041; F02M 37/0046; F02M 21/0245; F04B 11/0091; F04B 11/0016; F04B 11/0025; F04B 11/0033; F04B 19/22; F04C 15/0049
See application file for complete search history.

(56) References Cited

U.S. PATENT DOCUMENTS

| | | | | |
|---|---|---|---|---|
| 2015/0017041 | A1* | 1/2015 | Usui | F02M 59/442 417/540 |
| 2016/0258427 | A1* | 9/2016 | Suda | F04B 11/0091 |
| 2018/0258892 | A1 | 9/2018 | Zankl et al. | |

* cited by examiner

HIGH-PRESSURE FUEL PUMP FOR A FUEL INJECTION SYSTEM

CROSS-REFERENCE TO RELATED APPLICATIONS

This application claims priority to DE Application No. 10 2018 204 556.9 filed Mar. 26, 2018, the contents of which are hereby incorporated by reference in their entirety.

TECHNICAL FIELD

The present disclosure relates to internal combustion engines. Various embodiments of the teachings herein may include high-pressure fuel pumps for applying high pressure to a fuel in a fuel injection system.

BACKGROUND

High-pressure fuel pumps are used in fuel injection systems in order to compress, and thus apply high pressure to, fuel. The fuel under high pressure is then injected, by means of a fuel injection device, into combustion chambers of an internal combustion engine. In the case of gasoline internal combustion engines, the pressure lies in a range from 150 bar to 400 bar, and in the case of diesel internal combustion engines, the pressure lies in a range from 1500 bar to 3000 bar. The more the fuel is compressed, the lower the emissions produced during the combustion process. This may provide emissions reduction which is increasingly sought-after and required by law.

These high-pressure fuel pumps usually comprise piston pumps, the fuel being compressed by a pump piston in a pressure chamber by means of a translational movement of the pump piston. The non-uniform delivery of such piston pumps may, on a low-pressure side of the high-pressure fuel pump, produce fluctuations in the volume flow, which are associated with pressure fluctuations in the system as a whole. Also, for example, actively controlled inlet valves cause pressure pulsations on the low-pressure side of the high-pressure fuel pump during operation. As a consequence of these fluctuations or pressure pulsations, the high-pressure fuel pump can experience filling losses, so that correct metering of the quantity of fuel required in the internal combustion engine cannot be ensured. In addition, these pressure pulsations induce oscillations in components of the high-pressure fuel pump, which can cause undesirable noise or even damage to the individual components.

Therefore, in order to damp these pressure pulsations, low-pressure dampers are used on the low-pressure side, these dampers operating as hydraulic accumulators which smooth the fluctuations in the volume flow and thus reduce the resulting pressure pulsations. To that end, these low-pressure dampers usually have deformable elements. Now, if the pressure at the low-pressure side rises, these elements deform, thus making space for the excess fuel in the volume flow. When the pressure subsequently drops, the deformable element returns to its original shape and the stored fuel is thus released again. For example, low-pressure dampers are known which are installed on a head region of the high-pressure fuel pump. In addition to the greatest possible volumetric capacity, however, a further demand on a low-pressure damper is that it takes up the least possible structural space. Furthermore, it should be as inexpensive as possible and exhibit little complexity in terms of production.

SUMMARY

The teachings of the present disclosure describe various high-pressure fuel pumps that are improved in this respect.

For example, some embodiments include a high-pressure fuel pump (10) for applying high pressure to a fuel (12) in a fuel injection system of an internal combustion engine, having: a housing (14) having a housing bore (16) which forms, at a first end region (18), a pressure chamber (20) in which high pressure is applied to the fuel (12), and forms, at a second end region (22), a leakage chamber (24); a pump piston (26) which is guided in a pump piston guiding region (28), formed by a pump piston guiding section (30) of the housing (14), of the housing bore (16), and which, during operation of the high-pressure fuel pump (10), moves in translation between the pressure chamber (20) and the leakage chamber (24) along an axis of movement (32); wherein the leakage chamber (24) has a leakage collecting region (34) and an equalizing region (40), wherein the equalizing region (40) is arranged in circular annular fashion around the pump piston guiding section (30) of the housing (14) and extends parallel to the axis of movement (32) from the leakage collecting region (34) toward the pressure chamber (20); and a low-pressure damper (42) which is arranged in the equalizing region (40), wherein the low-pressure damper (42) is formed as an annular piston damper (44) and has an annular piston (46) which is guided in axially movable fashion in an annular bushing (48).

In some embodiments, the annular piston damper (44) is arranged around the pump piston guiding section (30) of the housing (14) and extends from the leakage collecting region (34) toward the pressure chamber (20).

In some embodiments, the piston (46) is formed as a hollow piston (50) with a cavity (52) arranged in the hollow piston (50), wherein the bushing (48) bounds an internal volume (54) in which the hollow piston (50) is guided, wherein the cavity (52) is formed so as to be open towards the internal volume (54).

In some embodiments, a damper chamber (56) formed by the cavity (52) and the internal volume (54) is filled with a pressurized gas in order to form a gas pressure spring (58).

In some embodiments, in a damper chamber (56) formed by the cavity (52) and the internal volume (54), there is arranged a pressure spring (60) which is supported on a piston crown (62) of the hollow piston (50) and on a bushing base (64) situated opposite the piston crown (62).

In some embodiments, a seal arrangement (66) is provided between the piston (46) and the bushing (48), wherein the seal arrangement (66) is formed in particular by a shaft sealing ring between piston (46) and bushing (48) or by a rolling diaphragm (68) between piston (46) and bushing (48) or by a piston ring.

In some embodiments, between the piston (46) and the bushing (48), there is provided a seal arrangement (66) which has at least one sealing projection (70) on the piston (46) and/or on the bushing (48).

In some embodiments, the leakage collecting region (34) is bounded by a sealing shell (36) which is secured by pressing to a housing wall (38) of the housing bore (16).

In some embodiments, the low-pressure damper (42) is secured to the housing wall (38) and/or to the sealing shell (36) and/or to the pump piston guiding section (30).

BRIEF DESCRIPTION OF THE DRAWINGS

Various embodiments are explained in more detail below by means of the appended drawings, in which.

DETAILED DESCRIPTION

Figure 1:
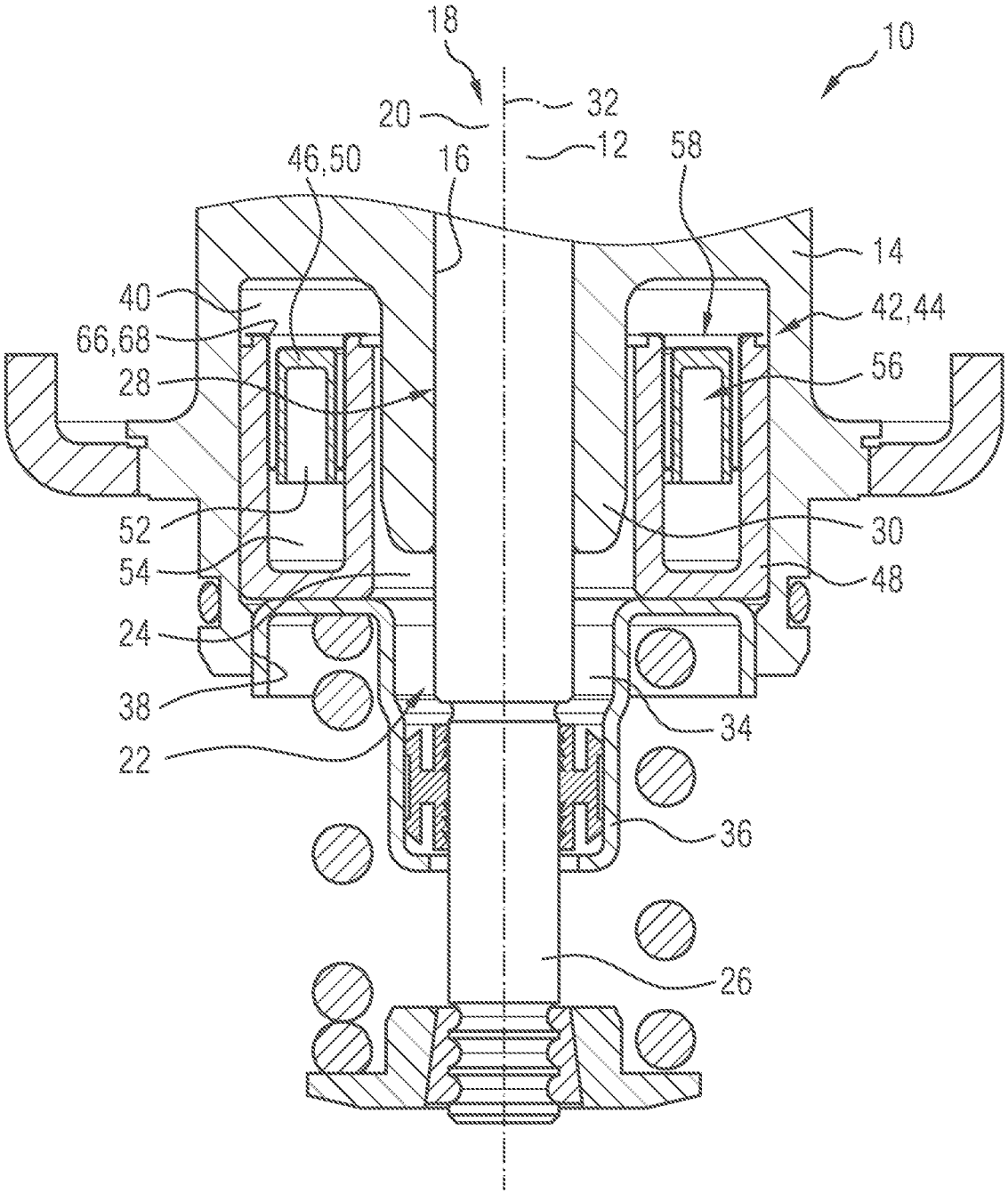
FIG. 1 is a longitudinal sectional illustration of a high-pressure fuel pump having a low-pressure damper incorporating teachings of the present disclosure.

In some embodiments, a high-pressure fuel pump for applying high pressure to fuel in a fuel injection system has a housing having a housing bore which forms, at a first end region, a pressure chamber in which high pressure is applied to the fuel, and which forms, at a second end region, a leakage chamber. The high-pressure fuel pump also comprises a pump piston which is guided in a pump piston guiding region, formed by a pump piston guiding section of the housing, of the housing bore, and which, during operation of the high-pressure fuel pump, moves in translation between the pressure chamber and the leakage chamber along an axis of movement. The leakage chamber has a leakage collecting region and an equalizing region, wherein the equalizing region is arranged in circular annular fashion around the pump piston guiding section of the housing and extends parallel to the axis of movement from the leakage collecting region toward the pressure chamber. Furthermore, the high-pressure fuel pump comprises a low-pressure damper, which is arranged in the equalizing region. The low-pressure damper is formed as an annular piston damper and has an annular piston which is guided in axially movable fashion in an annular bushing.

It was hitherto known to provide low-pressure dampers at a head end of the housing of the high-pressure fuel pump. By contrast, some embodiments include a low-pressure damper inside the housing of the high-pressure fuel pump, specifically below the pump piston in the leakage chamber which collects leakage fuel escaping along the pump piston from the pressure chamber. Structural space is thus freed up for other elements at a head end of the high-pressure fuel pump. In addition, an external interface which must be sealed is no longer necessary since the low-pressure damper is arranged within the housing of the high-pressure fuel pump. Also, pump noises are projected no longer outward but rather into an adjoining engine block underneath. This makes the high-pressure fuel pump quieter overall.

In some embodiments, the leakage chamber of the high-pressure fuel pump is made up of two regions, namely a leakage collecting region and an equalizing region. In that context, the leakage collecting region is arranged only at the specific point where the leakage fuel exits the pump piston guiding section of the housing. The equalizing region makes available the actual volume of the leakage chamber. In some embodiments, the equalizing region is arranged in a circular annular manner around the pump piston guiding section, which may help with regard to the overall architecture of the high-pressure fuel pump.

In some embodiments, the equalizing region can therefore absorb and divert forces which arise in the housing when the housing is attached to other elements of the fuel injection system. The low-pressure damper is arranged no longer only generally in the leakage chamber, but rather specifically in this equalizing region. Particularly advantageously, said low-pressure damper is located exclusively in this equalizing region of the leakage chamber, since the equalizing region provides the greatest volume for a low-pressure damper, which can therefore also be made as large as possible. It is therefore possible to provide a low-pressure damper with a large volumetric capacity, which nevertheless requires no additional structural space of the high-pressure fuel pump, but rather uses the existing structural space.

To achieve a particularly good damper action, the low-pressure damper may be formed as an annular piston damper and, to that end, is of multi-part construction. Said low-pressure damper has not only an annular piston but also an annular bushing, in which the piston is guided in axially movable fashion. That is to say, the piston can perform an axial movement in the bushing, wherein the axial movement is parallel to the movement axis of the pump piston. If pressure pulsations now occur in the low-pressure region of the high-pressure fuel pump, the piston can move axially relative to the bushing and thus cushion the pressure pulsations.

In some embodiments, the annular piston damper may be arranged around the pump piston guiding section of the housing, and extends from the leakage collecting region toward the pressure chamber. By means of this, the low-pressure damper can fill the entire space of the equalizing region and thus achieve a particularly good action.

The piston may be formed as a hollow piston with a cavity arranged in the hollow piston. The bushing bounds an internal volume in which the hollow piston is guided. The hollow piston may be open toward the internal volume. Thus, the hollow piston acts as a separating element between the equalizing region, in which fuel is present as medium, and the internal volume of the bushing, in which gas, preferably air, is situated. Said gas is compressed as a result of the movement of the piston when pressure pulsations act on the piston and can expand again after said piston is relieved of load. The pressure pulsations are thus cushioned.

In some embodiments, a damper chamber formed by the cavity and the internal volume is filled with a pressurized gas in order to form a gas pressure spring. Then, in the event of a release of load, the pressurized gas causes the piston to be reset into an initial position.

In some embodiments, it is however also possible that, in a damper chamber formed by the cavity and the internal volume, there is arranged a pressure spring which is supported on a piston crown of the hollow piston and on a bushing base situated opposite the piston crown. Said pressure spring can then likewise ensure that, when the pressure pulsations have abated, the piston can return into its initial position again.

The resetting and preloading of the piston can thus be realized for example by means of gas pressure—if the damper chamber forms an enclosed gas volume—or by means of the pressure spring or else by means of a combination of both.

In some embodiments, a seal arrangement is provided between the piston and the bushing, wherein the seal arrangement is formed in particular by a shaft sealing ring between piston and bushing or by a rolling diaphragm between piston and bushing or by a piston ring. A situation may be prevented in which fuel ingresses into the annular piston damper and impairs the function thereof.

In some embodiments, between the piston and the bushing, there is provided a seal arrangement which has at least one sealing projection on the piston and/or on the bushing. The sealing function which is intended to be present at an inner diameter of the bushing and an outer diameter on the piston can thus be realized by means of additional elements such as for example piston rings, shaft sealing rings, rolling diaphragms etc., or else integrated into the design of piston and bushing.

In order to discharge any fuel that ingresses into the damper chamber, the annular piston damper may be equipped with a ventilation bore or else with a ventilation valve. Here, the ventilation may be performed into an environment or else for example into an engine oil circuit.

In some embodiments, the leakage collecting region may be bounded by a sealing shell which is secured by pressing to a housing wall of the housing bore. The pressing of the sealing shell against the housing wall of the housing bore seals off the leakage region with respect to the outside. The seal is further improved by virtue of the fact that the sealing shell may be welded or screw-fitted in addition to the pressing action.

In some embodiments, the low-pressure damper may be secured to the housing wall and/or to the sealing shell and/or to the pump piston guiding section.

FIG. 1 is a longitudinal sectional illustration of a high-pressure fuel pump 10 incorporating teachings of the present disclosure which can be used to apply high pressure to the fuel 12. The high-pressure fuel pump 10 has a housing 14 with a housing bore 16. The housing bore 16 forms, at a first end region 18, a pressure chamber 20 in which, during operation, high pressure is applied to the fuel 12 by the volume of the pressure chamber 20 periodically contracting and expanding. The housing bore 16 also forms, at a second end region 22, a leakage chamber 24.

The high-pressure fuel pump 10 has a pump piston 26 which is guided in the housing bore 16. To that end, the housing bore 16 has a special pump piston guiding region 28 which is formed by a pump piston guiding section 30 on the housing 14 and which projects into the leakage chamber 24. In operation, the pump piston 26 moves back and forth in translation along an axis of movement 32, between the pressure chamber 20 and the leakage chamber 24. As a consequence of this movement of the pump piston 26 in the pressure chamber 20, fuel 12 which is present in this pressure chamber 20 is compressed and thus subjected to high pressure. In the process, a small proportion of the fuel 12 flows downward, along the pump piston guiding region 28 between the pump piston 26 and the pump piston guiding section 30 of the housing 14, and into the leakage chamber 24.

The leakage chamber 24 forms, in that region along the axis of movement 32 which is below the pump piston guiding section 30, a leakage collecting region 34 in which the fuel leakage from the pressure chamber 20 can be collected. In order to prevent this leakage fuel mixing with for example lubricating oil in the drive region of the pump piston 26, the leakage chamber 24 is sealed in a fluid-tight manner with a sealing shell 36 which is pressed against a housing wall 38 of the housing bore 16 and possibly additionally secured by welding or screw-fitting. Thus, the sealing shell 36 and the housing wall 38 respectively form a boundary for the leakage collecting region 34.

The leakage chamber 24 also has, in addition to the leakage collecting region 34, an equalizing region 40 which performs multiple functions. Firstly, it serves to cushion a pressure change below the pump piston 26, which results from the movement of the pump piston 26. Secondly, this equalizing region 40 is designed such that it also redirects forces which act on the housing 14 from outside the housing 14, for example as a consequence of the housing 14 being secured to other elements of a fuel injection system. To that end, the equalizing region 40 is arranged in circular annular fashion around the pump piston guiding section 30. Said equalizing region extends parallel to the axis of movement 32, from the leakage collecting region 34 toward the pressure chamber 20.

Figure 2:
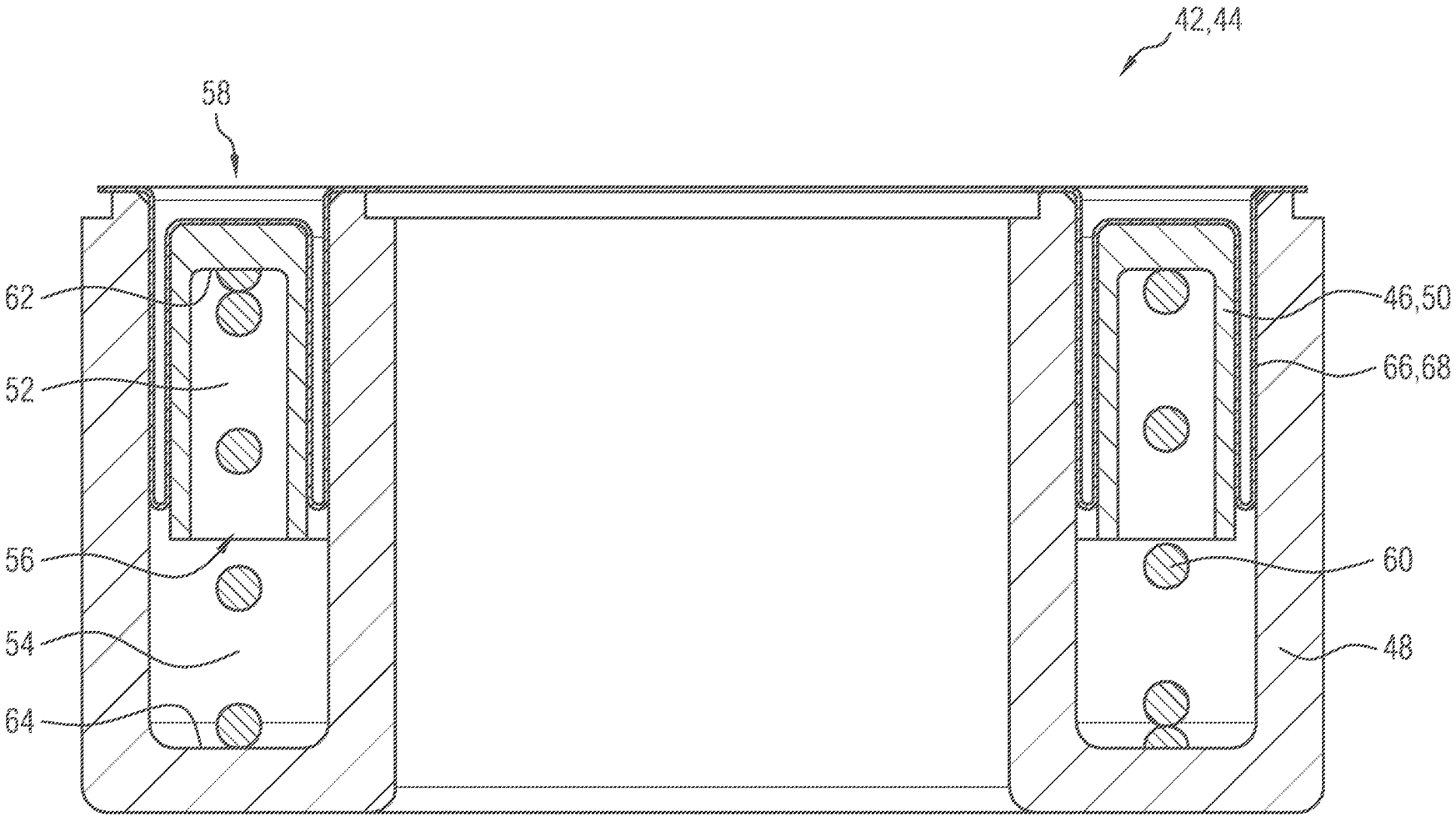
FIG. 2 shows the low-pressure damper from FIG. 1 in an enlarged illustration and with a pressure spring.

A first embodiment of a low-pressure damper 42 is arranged in the leakage chamber 24, specifically such that the low-pressure damper 42 is located in the equalizing region 40 of the leakage chamber 24. For securing purposes, the low-pressure damper 42 may for example be secured to the housing wall 38 or to the sealing shell 36 or to the pump piston guiding section 30. The low-pressure damper 42 is shown in greater detail in FIG. 2. The low-pressure damper 42 shown in FIG. 2 is formed as an annular piston damper 44 and has an annular piston 46 and an annular bushing 48. The piston 46 is guided in the bushing 48 so as to be axially movable along the movement axis 32. The annular piston damper 44 is advantageously arranged around the pump piston guiding section 30 of the housing 14 and extends from the leakage collecting region 34 toward the pressure chamber 20.

The piston 46 is formed as a hollow piston 50 and has a cavity 52. The bushing 48 bounds an internal volume 54 in which the hollow piston 50 is guided. The hollow piston 50 may be designed as a closed piston, though the first embodiment shows merely a hollow piston 50 which is formed so as to be open toward the internal volume 54. The cavity 52 and the internal volume 54 together form a damper chamber 56 of the low-pressure damper 42, wherein the damper chamber 56 is filled with a gas, for example air.

If pressure pulsations now occur in the high-pressure fuel pump 10, the hollow piston 50 can move axially inward in the bushing 48, wherein the gas situated in the damper chamber 56 is compressed, and the pressure pulsations are thus cushioned. In FIG. 1, the annular piston damper 44 is formed as a gas pressure spring 58, and, to that end, has a pressurized gas in the damper chamber 56. If the pressure pulsations in the high-pressure fuel pump 10 abate, the gas pressure in the interior of the damper chamber 56 causes the hollow piston 50 to be reset upward and thus into its initial position.

FIG. 2 shows the low-pressure damper 42 from FIG. 1 in an enlarged illustration, wherein, additionally, a pressure spring 60 is arranged between piston 56 and bushing 48, which pressure spring resets the piston 46 into its initial position again after it has been acted on by pressure pulsations. To that end, the pressure spring 60 is supported on a piston crown 62 of the hollow piston 50 and, opposite this, on a bushing base 64 of the bushing 48. The annular piston damper 44 in FIG. 2 may additionally also be formed as a gas pressure spring 58, which interacts jointly with the pressure spring 60.

In the first embodiment in FIG. 1 and FIG. 2, a seal arrangement 66 in the form of a rolling diaphragm 68 is arranged between the piston 46 and the bushing 48. Said rolling diaphragm 68 prevents fuel 12 that is situated in the equalizing region 40 from ingressing between piston 46 and bushing 48 and impairing the action of the annular piston damper 44. As an alternative to the rolling diaphragm 68 that is shown, use may also be made of shaft sealing rings or piston rings.

Figure 3:
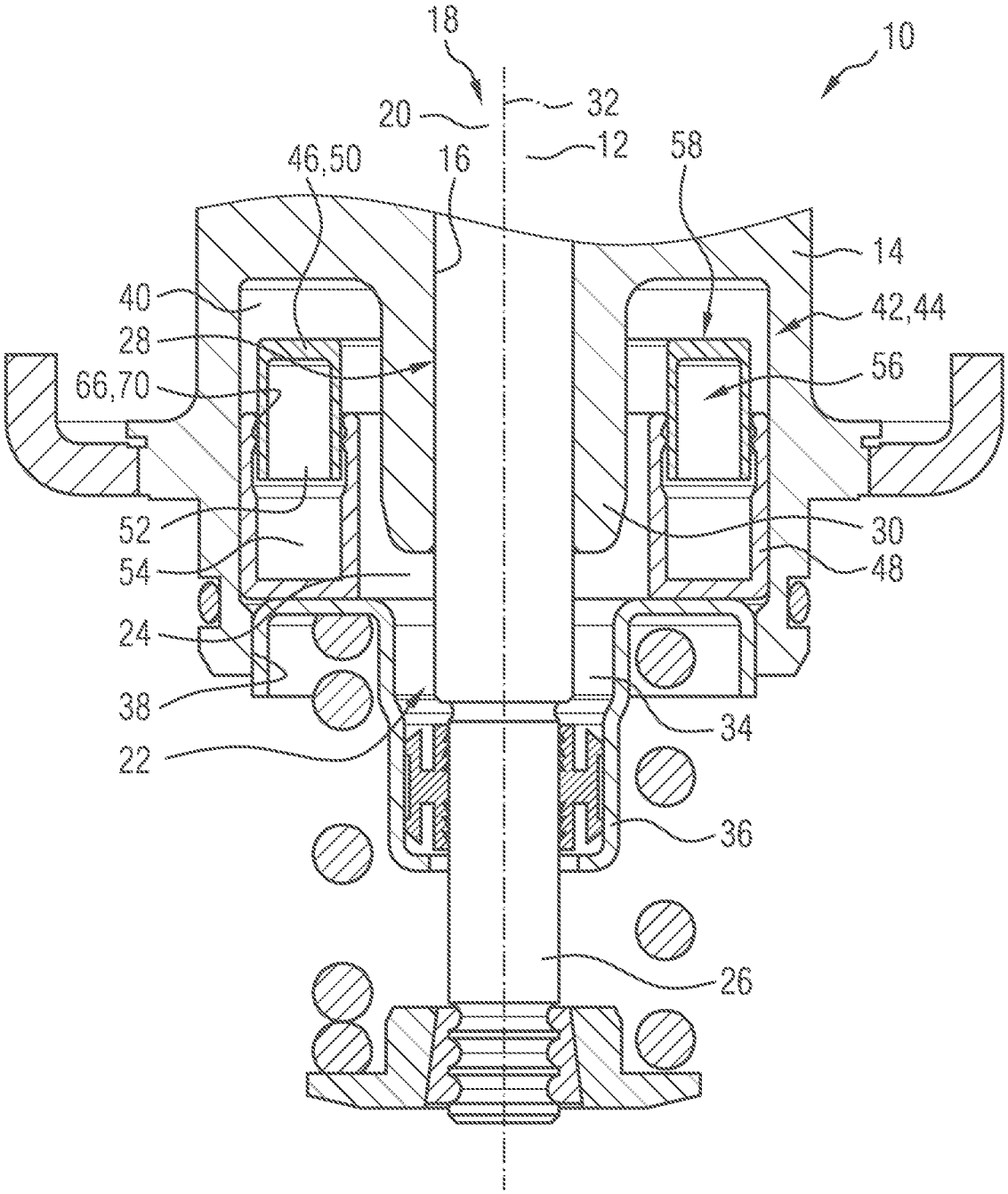
FIG. 3 is a longitudinal sectional illustration of a high-pressure fuel pump having a low-pressure damper incorporating teachings of the present disclosure.
Figure 4:
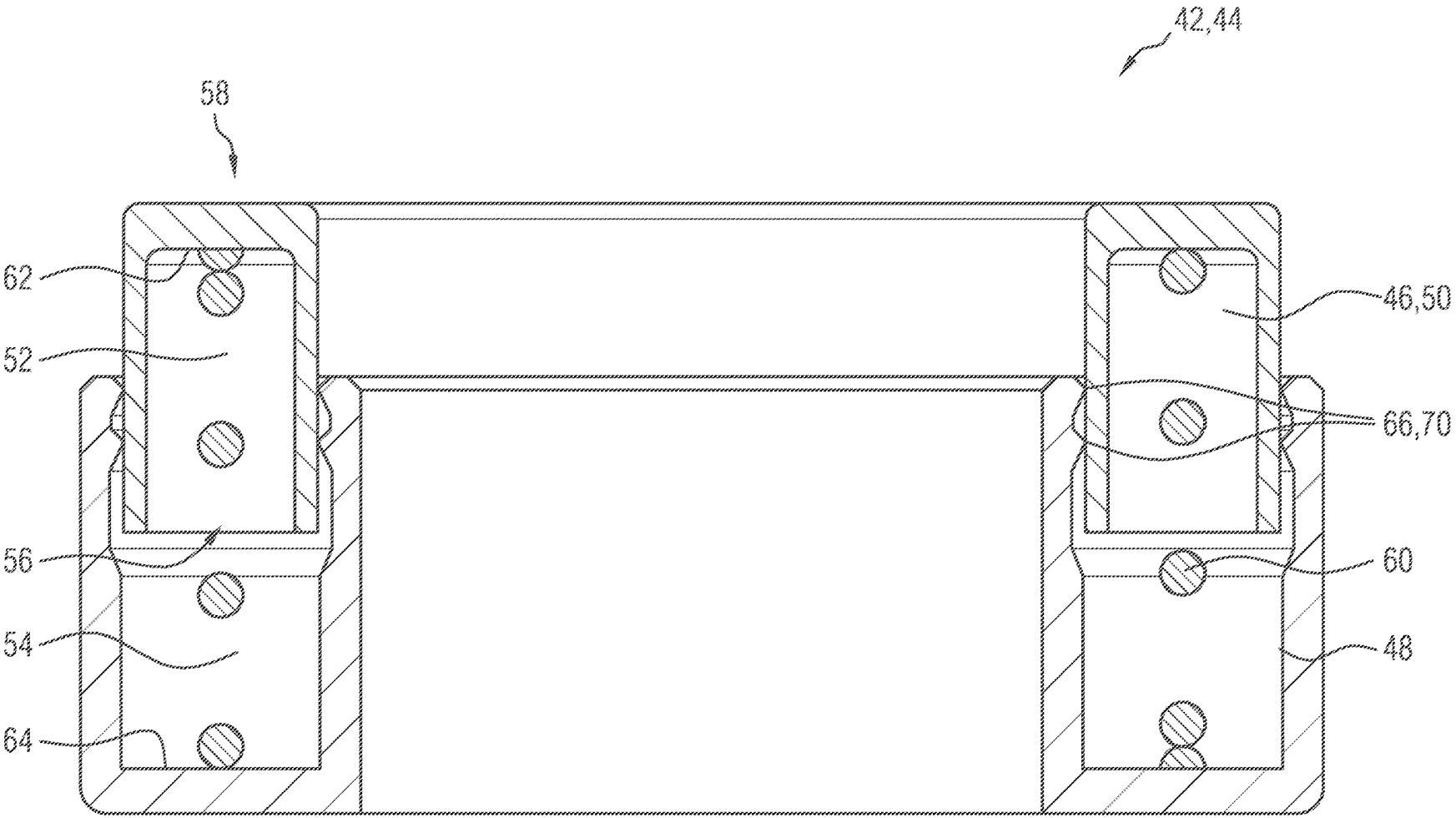
FIG. 4 shows the low-pressure damper from FIG. 3 in an enlarged illustration and with a pressure spring.

FIG. 3 and FIG. 4 show a second embodiment of the annular piston damper 44, wherein, instead of a rolling diaphragm 68 or similar seal arrangements 66, sealing projections 40 are provided on the bushing 48. Otherwise, the second embodiment is movable relative to the first embodiment. The provision of the low-pressure damper 42 in the leakage chamber 24 of the high-pressure fuel pump 10 makes it possible to provide maximum flexibility in terms of the interfaces at the head of the high-pressure fuel pump 10. For example, a metering valve can then easily be arranged at the upper end of the housing 14, axially with respect to the pump piston 26, and thus provide a direct suction path from a reservoir, for example from a tank. This makes it possible to increase the volumetric efficiency of the high-pressure fuel pump 10.

The invention claimed is:

1. A high-pressure fuel pump for applying high pressure to a fuel in a fuel injection system of an internal combustion engine, the pump comprising:

a housing defining a housing bore with a pressure chamber in a first end region and a leakage chamber in a second end region;

a pump piston guided in a pump piston guiding region formed by a pump piston guiding section of the housing, the pump piston, during operation of the high-pressure fuel pump moved in translation between the pressure chamber and the leakage chamber along an axis;

wherein the leakage chamber includes a leakage collecting region and an equalizing region arranged in circular annular fashion around the pump piston guiding section and extending parallel to the axis from the leakage collecting region toward the pressure chamber; and a low-pressure damper arranged in the equalizing region, the low-pressure damper comprising an annular piston damper and an annular piston guided to move along the axis within an annular bushing.

2. The high-pressure fuel pump as claimed in claim 1, wherein:

the annular piston damper is arranged around the pump piston guiding section; and the annular piston damper extends from the leakage collecting region toward the pressure chamber.

3. The high-pressure fuel pump as claimed in claim 1, wherein:

the piston comprises a hollow rod with a cavity defined therein; and the bushing bounds an internal volume in which the piston is guided, wherein the cavity opens towards the internal volume.

4. The high-pressure fuel pump as claimed in claim 3, wherein a damper chamber formed by the cavity and the internal volume is filled with a pressurized gas to form a gas pressure spring.

5. The high-pressure fuel pump as claimed in claim 3, further comprising a spring in a damper chamber formed by the cavity and the internal volume, the spring supported on a piston crown of the hollow piston and on a bushing base opposite the piston crown.

6. The high-pressure fuel pump as claimed in claim 1, further comprising a seal arrangement between the piston and the bushing, wherein the seal arrangement includes a shaft sealing ring between the piston and the bushing or a rolling diaphragm between the piston and the bushing or a piston ring.

7. The high-pressure fuel pump as claimed in claim 1, further comprising a seal arrangement between the piston and the bushing, the seal arrangement including a sealing projection on the piston and/or on the bushing.

8. The high-pressure fuel pump as claimed in claim 1, further comprising a sealing shell bounding the leakage collecting region, the sealing shell secured by pressing to a housing wall of the housing bore.

9. The high-pressure fuel pump as claimed in claim 8, wherein the low-pressure damper is secured to the housing wall and/or to the sealing shell and/or to the pump piston guiding section.

* * * * *